United States Patent [19]

Altherr et al.

[11] 4,255,153

[45] Mar. 10, 1981

[54] DISPERSE DYEING OF TRIACETATE

[75] Inventors: Eric Altherr, Chester; Ronald L. Hafer, Florham Park; Richard L. Pepin, Verona, all of N.J.

[73] Assignee: Sandoz, Inc., East Hanover, N.J.

[21] Appl. No.: 79,453

[22] Filed: Sep. 27, 1979

[51] Int. Cl.[3] ..... C09B 67/00; D06P 1/62

[52] U.S. Cl. ..... 8/582; 8/921

[58] Field of Search ..... 8/92, 582, 921

[56] References Cited

U.S. PATENT DOCUMENTS

| | | | |
|---|---|---|---|
| 2,923,593 | 2/1960 | Olpin et al. | 8/92 |
| 3,069,219 | 12/1962 | Olpin et al. | 8/92 |
| 3,233,961 | 2/1966 | Salvin et al. | 8/92 |
| 3,820,952 | 6/1974 | Dellian et al. | 8/92 |
| 3,932,121 | 1/1976 | Kawakami et al. | 8/92 |
| 4,072,465 | 2/1978 | Daeuble | 8/92 |

*Primary Examiner*—A. Lionel Clingman

*Attorney, Agent, or Firm*—Gerald D. Sharkin; Richard E. Vila; Thomas C. Doyle

[57] ABSTRACT

Textile materials containing at least 50% by weight triacetate fibers are dyed with disperse dyes in an aqueous dyebath containing an emulsifier and, as carrier, an aliphatic dicarboxylic acid diester having 6 to 24 carbon atoms, such as dibutyl maleate.

7 Claims, No Drawings

DISPERSE DYEING OF TRIACETATE

This invention relates to an improved process for the disperse dyeing of cellulose triacetate (hereinafter referred to by its more common name "triacetate").

It is known that triacetate fibers can be dyed with disperse dyes in an aqueous dye liquor containing a carrier and an emulsifier. The carriers heretofore employed have been aromatic compounds such as butyl benzoate, methyl salicylate, dialkylphthalate, biphenyl, alkyl biphenyls, chlorinated benzenes and o-phenylphenol. Such aromatic compounds suffer one or more disadvantages which are becoming less tolerable as their use expands and society becomes more concerned about the quality of the environment. These disadvantages include strong odor, leading to poor air quality, low biodegradability, leading to water pollution, and toxicity. Moreover, unless they are removed by a scouring and heat treatment after dyeing, quantities of such compounds which are absorbed during the dyeing give the fabric an unpleasant odor and may reduce the lightfastness of the dyeing.

According to the present invention, the aforementioned disadvantages are substantially reduced or eliminated by employing as carrier in the disperse dyeing of triacetate an aliphatic dicarboxylic acid diester containing from 6 to 24 carbon atoms.

The dicarboxylic acid diester (hereinafter "diester") may be saturated or unsaturated, branched or straight chain. Preferably, the diester contains 8 to 20 carbon atoms, more preferably 10 to 16. Suitable compounds are diesters of dicarboxylic acids such as oxalic, malonic, maleic, fumaric, succinic, glutaric and adipic. The two ester moieties of the diester may be derived from the same or different straight or branched aliphatic alcohols having 1 to 10, preferably 1 to 8, more preferably 2 to 6 carbon atoms, with those derived from n-butanol being most preferred.

Specific examples of suitable diesters are dimethyl adipate, dimethyl glutarate, dimethyl succinate, diethyl adipate, diethyl fumarate, dioctyl maleate, dioctyl fumarate, dioctyl adipate, and especially dibutyl oxalate, dibutyl fumarate and dibutyl maleate, with the last mentioned being most preferred. Mixtures of the diesters may also be used.

The amount of diester employed in the dye liquor will vary somewhat, depending on the depth of shade desired and the particular dyeing method employed. In general, it will range from 0.01 to 10% based on the weight of the material to be dyed (o.w.f.). Preferably, the diester is employed in an amount of from 0.1 to 6%, most preferably 2 to 5% o.w.f.

In addition to the diester, the dye liquor should contain an emulsifier. Suitable emulsifiers for use in the disperse dyeing of triacetate are well known in the art and the same may be employed in the process of the instant invention. These include nonionic surfactants, such as alkoxylated, especially polyethoxylated fatty acids and sorbitan-fatty acid esters, such as polyethoxylated castor oil and polyethoxylated sorbitan monostearate and monooleate and anionic surfactants, such as alkylaryl sulfonates and mono- and diphosphate adducts of ethylene oxide and propylene oxide. Such surfactants are commercially available under the tradenames Witcomul 1287, Tween 60, Tween 80, Sponto 232, Sponto 234, AHCO AB-118, Gafac RE-610, Gafac RS-410 and Sulframin 1298. Compounds of non-aromatic character are preferred. Especially suitable are mixtures of nonionic and anionic surfactants, particularly those in which the ratio of nonionic to anionic compounds is in the range 4:1 to 1:5, especially 2:1 to 1:4, most especially 1:1 to 1:3.

The anionic surfactants may be employed as alkali metal or amine salts. Preferably, a sufficient amount of alkanol amine, such as mixed isopropanol amine, is added to give the corresponding amine salt.

The amount of emulsifier is not critical, so long as it is sufficient to promote uniform dispersion of the diester in the dyeing medium. Generally, a proportion of emulsifier which is about 2 to 60%, by weight of the diester is suitable, with amounts ranging from 10 to 35%, especially 20 to 30%, being preferred.

Most conveniently, the diester and emulsifier are combined prior to being added to the dyeing medium.

Disperse dyes for dyeing triacetate fibers are well known in the art, e.g. Colour Index, 3rd Edition, Volume 2, and any such dyes normally suitable for this purpose can be used in the process of this invention.

In addition to the dye carrier and emulsifier, the dye liquor should contain sufficient water to give a satisfactory liquor:goods ratio. The present invention does not involve any departure from conventional practice in this regard and it will be well within the skill of the art to determine what the liquor:goods ratio should be depending on whether atmospheric or pressure dyeing is employed and on what type of equipment is used, e.g. beam, beck, jig, jet, paddle or rotary drum. In general, enough water is employed to give a liquor:goods ratio of about 3:1 to about 40:1.

The particular dyeing method employed is not critical and may be any one of those conventionally employed for the dyeing of triacetate. Such methods are disclosed in Technical Bulletin TBT 4 of Celanese Fibers Marketing Company and in Technical Bulletin No. 1-205/76 of Sandoz Colors and Chemicals. Temperatures of about 200° to 212° F. are used under atmospheric conditions, while temperatures up to about 270° F. may be used in pressurized dyeing.

The present invention can be employed in the dyeing of triacetate and blends of triacetate with other textile materials such as wool, nylon and polyester, wherein the triacetate content is at least 50%, preferably at least 80%, by weight.

While avoiding the disadvantages associated with the use of aromatic carriers, the diesters employed in accordance with the present invention give dyeings that are characterized by excellent migration levelness and yield.

The following examples illustrate the invention.

EXAMPLE 1

A sample of Arnel® tricot fabric is introduced into a dyebath containing sufficient water to give a liquor:goods ratio of 15:1 plus the following components added in the order specified and in the stated proportions based on the weight of the fabric

- 2.0% monosodium phosphate
- 5.0% of a mixture consisting of, per 100 parts by weight
  - 80 parts dibutyl maleate
  - 5 parts Witcomul® nonionic surfactant
  - 3 parts Tween® 60 polyoxyethylated sorbitan monostearate anionic surfactant
  - 3 parts Tween® 80 polyoxyethylated sorbitan mono-oleate anionic surfactant 3.89 parts Gafac® RE-610 organic phosphate ester anionic surfactant 3.89 parts Gafac® RS-410 organic phosphate ester anionic surfactant 2.22 parts mixed isopropanolamine 2.0% Foron® Navy S-2GL (Disperse Blue 79)

0.2% Artisil® Yellow G (Disperse Yellow 3) Acetic acid to adjust the pH to 5.5.

The temperature of the dyebath is increased from an initial temperature of 80° F. to a temperature of 220° F. at a rate of 3° F./minute and then maintained at 220° F. for 60 minutes. The dyebath is then cooled and the fabric is removed and rinsed in water at 140° F. for 5 minutes and dried. A blue dyeing is obtained which is characterized by excellent levelness.

EXAMPLES 2–6

Good quality dyeings are obtained when the procedure of Example 1 is repeated employing in place of the dibutyl maleate the following diesters: dibutyl oxalate, dibutyl fumarate, dimethyl glutarate, dimethyl succinate and a mixture comprising 90% dimethyl adipate and 10% dimethyl glutarate.

EXAMPLES 7 AND 8

The procedure of Example 1 is repeated, except that the amounts of diester-surfactant mixture employed are 3% and 4%, respectively. Similar results are obtained.

EXAMPLE 9

The procedure of Example 1 is repeated, except that in place of the Tween® 60 and Tween® 80, the diester surfactant mixture contained 1.5 parts of Sponto® 232 anionic surfactant and 3.5 parts of Sponto® 234 anionic surfactant, each of which is a blend of oil soluble metal sulfonates and polyoxyethylene ethers. A blue dyeing of good levelness was obtained.

We claim:

1. In a process wherein a fabric comprising cellulose triacetate is dyed with a disperse dye in an aqueous liquor containing a carrier for the dye, the improvement which comprises carrying out said dyeing in the presence of an aliphatic dicarboxylic acid diester of 6 to 24 carbon atoms as the carrier.

2. A process according to claim 1 wherein the diester contains 10 to 16 carbon atoms.

3. A process according to claim 1 wherein the diester is a di-$C_{1-10}$alkyl ester of oxalic, malonic, maleic, fumaric, succinic, glutaric or adipic acid.

4. A process according to claim 3 wherein the diester is dibutyl oxalate, dibutyl fumarate or dibutyl maleate.

5. A process according to claim 4 wherein the diester is dibutyl maleate.

6. A process according to claim 1 wherein the amount of diester is about 0.01 to 10% based on the weight of the fabric.

7. A process according to claim 1 wherein the dyebath contains, as an emulsifier for the carrier, a mixture of anionic and nonionic surface active agents.

* * * * *